United States Patent [19]

Ooniwa et al.

[11] Patent Number: 4,936,965

[45] Date of Patent: Jun. 26, 1990

[54] METHOD FOR CONTINUOUSLY ELECTRO-TINPLATING METALLIC MATERIAL

[75] Inventors: Naoyuki Ooniwa; Yoshinori Yomura; Tomoyoshi Ohkita, all of Tokyo; Hiroyuki Nakada, Nihonbashi; Saori Kajihara, Nihonbashi; Kazuhide Ohe, Nihonbashi; Mitsuo Okahara, 9-5, 1-chome, Yuyamadai, Kawanishi City, Hyogo Pref., all of Japan

[73] Assignees: NKK Corporation; TDK Corporation, both of Tokyo; Mitsuo Okahara, Kawanishi, all of Japan

[21] Appl. No.: 417,258

[22] Filed: Oct. 5, 1989

[30] Foreign Application Priority Data

Oct. 17, 1988 [JP] Japan ..... 63-261239

[51] Int. Cl.[5] ..... C25D 7/06

[52] U.S. Cl. ..... 204/28; 204/54.1

[58] Field of Search ..... 204/28, 54.1

[56] References Cited

U.S. PATENT DOCUMENTS 4,181,580 1/1980 Kitayama ..... 204/28

FOREIGN PATENT DOCUMENTS 61-73896 4/1986 Japan .

*Primary Examiner*—T. M. Tufariello

*Attorney, Agent, or Firm*—Frishauf Holtz Goodman & Woodward

[57] ABSTRACT

A method for continuously electro-tinplating a metallic material comprising the steps of: using an acidic electro-tinplating solution containing phenolsulfonic acid or a salt thereof and tin ion, using an insoluble anode, and causing a DC electric current to flow between the insoluble anode and a metallic material, while replenishing the acidic electro-tinplating solution with tin ion, thereby forming a tinplating layer on the surface of the metallic material. The above-mentioned anode comprises an electric-conductive substrate, and a film comprising at least iridium oxide, formed on the surface of the electric-conductive substrate.

7 Claims, No Drawings

METHOD FOR CONTINUOUSLY ELECTRO-TINPLATING METALLIC MATERIAL

REFERENCE TO PATENTS, APPLICATIONS AND PUBLICATIONS PERTINENT TO THE INVENTION

As far as we know, there is available the following prior art document pertinent to the present invention:

Japanese Patent Provisional Publication No. 61-73,896 dated Apr. 16, 1986.

The contents of the prior art disclosed in the above-mentioned prior art document will be discussed hereafter under the heading of the "BACKGROUND OF THE INVENTION".

FIELD OF THE INVENTION

The present invention relates to a method for continuously electro-tinplating a metallic material such as a metal strip or a metal wire.

BACKGROUND OF THE INVENTION

For the purpose of continuously electro-tinplating a metallic material such as a metal strip or a metal wire, the following methods are known:

(1) Method using a soluble anode:

This method comprises the steps of: using an acidic electro-tinplating solution containing phenolsulfonic acid or a salt thereof and tin ion, using a soluble anode comprising metallic tin, and causing a DC electric current to flow between the soluble anode and a metallic material to be tinplated, thereby forming a tinplating layer on the surface of the metallic material.

(2) Method using an insoluble anode:

This method comprises the steps of: using an acidic electro-tinplating solution containing phenolsulfonic acid or a salt thereof and tin ion, using an insoluble anode comprising a titanium plate, the surface of which is platinum-plated, and causing a DC electric current to flow between the insoluble anode and a metallic material to be tinplated, while replenishing the acidic electro-tinplating solution with tin ion, thereby forming a tinplating layer on the surface of the metallic material.

The method using a soluble anode comprising metallic tin mentioned under (1) above is advantageous in that dissolution of the soluble anode permits automatic replenishment of the acidic electro-tinplating solution with tin ion. This method involves however the following problems:

(a) Since the soluble anode has a higher dissolution efficiency into the electro-tinplating solution than an electrodeposition efficiency of tin to the metallic material, the electro-tinplating solution would contain an excessive amount of tin ion. As a result, the thickness of the tinplating layer formed on the surface of the metallic material is apt to be non-uniform.

(b) Along with the progress of dissolution of the soluble anode, the distance between the soluble anode and the metallic material changes. In order to keep a constant distance between the soluble anode and the metallic material, therefore, it is necessary to move the soluble anode toward the metallic material.

(c) The soluble anode after dissolution over a certain limit must be replaced with a new one. The necessity of frequent replacement of the soluble anode reduces the operating efficiency of tinplating.

The method using an insoluble anode comprising a titanium plate, the surface of which is platinumplated, mentioned under (2) above is advantageous in that the electro-tinplating solution never contains an excessive amount of tin ion since the acidic electro-tinplating solution can be replenished with tin ion in an amount corresponding to the electrodeposition efficiency of tin to the metallic material. Furthermore, since the insoluble anode is hardly dissolved, a constant distance can always be kept between the insoluble anode and the metallic material, and the necessity of replacement of the insoluble anode is remarkably reduced. According to this method, therefore, the problems encountered in the above-mentioned method using a soluble anode are solved, and it is possible to efficiently form a tinplating layer having a uniform thickness on the surface of the metallic material. This method has however the following problems:

(a) Anodic oxidation of phenolsulfonic acid or a salt thereof on the surface of the insoluble anode in the acidic electro-tinplating solution, causes the production of denaturations of phenolsulfonic acid or the salt thereof. The thus produced denaturations aggregate in the tinplating solution, and the aggregated denaturations adhere to the tinplating layer formed on the surface of the metallic material, thus causing deterioration of the quality of the tinplating layer.

(b) Oxygen gas produced on the surface of the insoluble anode during electrolysis causes oxidation of tin ion contained in the acidic electro-tinplating solution, to produce a large quantity of sludge in the tinplating solution. The thus produced sludge adheres to the tinplating layer formed on the surface of the metallic material, thus causing deterioration of the quality of the tinplating layer.

As a means to solve the problem described under (a) above, there is known the following additive for dispersing the denaturations of phenolsulfonic acid or the salt thereof, produced in the acidic electro-tinplating solution, into the tinplating solution so as to prevent the deterioration of the quality of the tinplating layer:

An additive for an acidic electro-tinplating solution, as represented by the following general formula (hereinafter referred to as the "prior art"), disclosed in Japanese Patent Provisional Publication No. 61-73,896 dated Apr. 16, 1986:

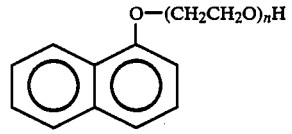

where, n = 7 to 12

The above-mentioned prior art has the following problems:

(1) There is available only a limited effect of dispersing the denaturations of phenolsulfonic acid or the salt thereof, produced in the acidic electro-tinplating solution, into the tinplating solution so as to prevent the deterioration of the quality of the tinplating layer.

(2) It is impossible to inhibit the production of sludge caused by the oxidation of tin ion in the acidic electro-tinplating solution.

Under such circumstances, there is a strong demand for the development of a method for stably forming a high-quality tinplating layer on the surface of a metallic material, which permits, when using an acidic electro-tinplating solution containing phenolsulfonic acid or a salt thereof and tin ion, using an insoluble anode, and causing a DC electric current to flow between the insoluble anode and the metallic material, while replenishing the acidic electro-tinplating solution with tin ion, thereby forming a tinplating layer on the surface of the metallic material, prevention of the production of denaturations of phenolsulfonic acid or the salt thereof in the acidic electro-tinplating solution, and furthermore, inhibition of the production of sludge caused by the oxidation of tin ion in the acidic electro-tinplating solution, but such a method has not as yet been proposed.

SUMMARY OF THE INVENTION

An object of the present invention is therefore to provide a method for stably forming a high-quality tinplating layer on the surface of a metallic material, which permits, when using an acidic electro-tinplating solution containing phenolsulfonic acid or a salt thereof and tin ion, using an insoluble anode, and causing a DC electric current to flow between the insoluble anode and the metallic material, while replenishing the acidic electro-tinplating solution with tin ion, thereby forming a tinplating layer on the surface of the metallic material, prevention of the production of denaturations of phenolsulfonic acid or the salt thereof in the acidic electro-tinplating solution, and furthermore, inhibition of the production of sludge caused by the oxidation of tin ion in the acidic electro-tinplating solution.

In accordance with one of the features of the present invention, there is provided, in a method for continuously electro-tinplating a metallic material, which comprises the steps of: using an acidic electro-tinplating solution containing phenolsulfonic acid or a salt thereof and tin ion, using an insoluble anode, and causing a DC electric current to flow between said insoluble anode and a metallic material, while replenishing said acidic electro-tinplating solution with tin ion, thereby forming a tinplating layer on the surface of said metallic material; the improvement characterized in that: said insoluble anode comprises an electric-conductive substrate, and a film comprising at least iridium oxide, formed on the surface of said electric-conductive substrate.

DETAILED DESCRIPTION OF PREFERRED EMBODIMENTS

From the above-mentioned point of view, extensive studies were carried out with a view to developing a method for stably forming a high-quality tinplating layer on the surface of a metallic material, which permits, when using an acidic electro-tinplating solution containing phenolsulfonic acid or a salt thereof and tin ion, using an insoluble anode, and causing a DC electric current to flow between the insoluble anode and the metallic material, while replenishing the acidic electro-tinplating solution with tin ion, thereby forming a tinplating layer on the surface of the metallic material, prevention of the production of denaturations of phenolsulfonic acid or the salt thereof in the acidic electro-tinplating solution, and furthermore, inhibition of the production of sludge caused by the oxidation of tin ion in the acidic electro-tinplating solution. As a result, the following findings were obtained:

(1) By using an insoluble anode which comprises an electric-conductive substrate, and a film comprising at least iridium oxide, formed on the surface of the electric-conductive substrate, it is possible to prevent the production of denaturations of phenolsulfonic acid or a salt thereof in the acidic electro-tinplating solution.

(2) By further additionally adding, to the acidic electro-tinplating solution containing phenolsulfonic acid or a salt thereof and tin ion, a brightener as presented by the following general formula:

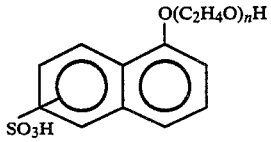

where, n = 8 to 14, in an amount within the range of from 0.5 to 15g per liter of the acidic electro-tinplating solution, it is possible, even when denaturations of phenolsulfonic acid or the salt thereof are produced in the tinplating solution, to cause the produced denaturations to be finely dispersed into the tinplating solution, and thus to prevent deterioration of the quality of the tinplating layer.

(3) When phenolsulfonic acid or the salt thereof in the acidic electro-tinplating solution contains free phenolsulfonic acid or a salt thereof in an amount within the range of from 5 to 25 g per liter of the acidic electro-tinplating solution, as converted into sulfuric acid, it is possible to inhibit the production of sludge caused by the oxidation of tin ion in the tinplating solution.

The present invention was developed on the basis of the above-mentioned findings. Now, the method of the present invention is described.

The method of the present invention comprises the steps of: using an acidic electro-tinplating solution containing phenolsulfonic acid or a salt thereof and tin ion; using an insoluble anode which comprises an electric-conductive substrate, and a film comprising at least iridium oxide, formed on the surface of the electric conductive substrate; and causing a DC electric current to flow between the insoluble anode and a metallic material, while replenishing the acidic electro-tinplating solution with tin ion, thereby forming a tinplating layer on the surface of the metallic material.

By using the insoluble anode which comprises the electric-conductive substrate, and the film comprising at least iridium oxide, formed on the surface of the electric-conductive substrate, it is possible to prevent the production of the denaturations of phenolsulfonic acid or the salt thereof in the acidic electro-tinplating solution. The reason is as follows:

The denaturations of phenolsulfonic acid or the salt thereof in the acidic electro-tinplating solution tend to easily occur when the potential of the insoluble anode increases. Since many fine cracks exist in the film comprising at least iridium oxide on the surface of the electric-conductive substrate of the insoluble anode used in the present invention, the insoluble anode has a relatively large surface area. This reduces the electric current density of the insoluble anode, thus inhibiting the increase in the potential thereof. Accordingly, the production of the denaturations of phenolsulfonic acid or the salt thereof is prevented.

Furthermore, since the insoluble anode used in the present invention has a small electric current density as mentioned above, oxygen gas produced on the surface of the insoluble anode during electrolysis has small bubbles. This reduces the degree of agitation of the acidic electro-tinplating solution caused by the bubbles of the produced oxygen gas, thus in turn reducing the contact between tin ions and oxygen ions in the tinplating solution. Therefore, the production of sludge caused by the oxidation of tin ion in the tinplating solution is inhibited. Thus, by the use of the above-mentioned insoluble anode, it is possible to inhibit the production of sludge caused by the oxidation of tin ion in the acidic electro-tinplating solution.

Metals preferable as the electric-conductive substrate of the insoluble anode include one metal or an alloy of at least two metals selected from the group consisting of titanium, tantalum, niobium and zirconium.

A preferable film comprising at least iridium oxide, formed on the surface of the electric-conductive substrate of the insoluble anode, comprises a mixture or a solid-solution of iridium oxide and at least one component selected from the group consisting of titanium oxide, tantalum oxide, niobium oxide and tin oxide. The ratio of the content of iridium oxide to the content of at least one component selected from the group consisting of titanium oxide, tantalum oxide, niobium oxide and tin oxide in the above-mentioned film is not particularly limited, but the content of at least one component selected from the above-mentioned group should preferably be up to 70 mol %, and more preferably, within the range of from 10 to 50 mol % of the total amount of the film.

The above-mentioned film may comprise a metal of the platinum group in addition to iridium oxide and at least one component selected from the group consisting of titanium oxide, tantalum oxide, niobium oxide and tin oxide, or may comprise iridium oxide and a metal of the platinum group. In any case, the content of the metal of the platinum group should preferably be up to 70 mol % and more preferably, up to 30 mol % of the total amount of the film.

A typical method for preparing the above-mentioned insoluble anode is as follows: Iridium oxide and at least one component selected from the group consisting of titanium butoxide, tantalum butoxide, niobium butoxide and tin butoxide are respectively dissolved in an organic solvent. The resultant solutions are mixed together and sufficiently stirred. The thus obtained mixed solution is applied onto the surface of the electric-conductive substrate and dried. The electric-conductive substrate, on the surface of which a film has thus been formed, is heated to a prescribed temperature to bake the film. The above-mentioned treatment comprising application of the mixed solution onto the surface of the electric-conductive substrate, drying and baking thereof is repeated a plurality of times. Thus the insoluble anode is available, which comprises the electric-conductive substrate, and the film formed on the surface of the electric-conductive substrate, which film comprises iridium oxide and at least one component selected from the group consisting of titanium oxide, tantalum oxide, niobium oxide and tin oxide.

By further additionally adding, to the acidic electro-tinplating solution containing phenolsulfonic acid or the salt thereof and tin ion, a brightener comprising a compound (ethoxylated α-naphthol sulfonic acid) as represented by the following formula:

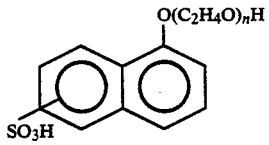

-continued
where, n = 8 to 14 it is possible, even when the denaturations of phenolsulfonic acid or the salt thereof are produced in the tinplating solution, to cause the produced denaturations to be finely dispersed into the tinplating solution.

As a result, even when the denaturations of phenolsulfonic acid or the salt thereof are produced in the tinplating solution, the produced denaturations never aggregate, and never adhere to the tinplating layer formed on the surface of the metallic material, unlikely in the conventional methods. Therefore, by using the insoluble anode which comprises the electric-conductive substrate, and the film comprising at least iridium oxide, formed on the surface of the electric-conductive substrate, and by further additionally adding the above-mentioned brightener to the acidic electro-tinplating solution, it is possible to more certainly prevent the deterioration of the quality of the tinplating layer, caused by the adhesion of the denaturations.

Furthermore, since the brightener combines with part of tin ions in the acidic electro-tinplating solution, contact between tin ions and oxygen ions in the tinplating solution is minimized. This inhibits the production of sludge caused by the oxidation of tin ions in the tinplating solution. By further additionally adding the above-mentioned brightener to the tinplating solution, as described above, it is possible to inhibit the production of sludge caused by the oxidation of tin ion in the tinplating solution.

The ethoxylation molar number "n" of the brightener as represented by the general formula:

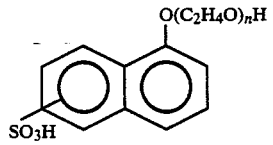

should be limited within the range of from 8 to 14. With an ethoxylation molar number "n" of under 8, the brightener is hardly dissolved in the tinplating solution. As a result, not only the effect brought by the addition of the brightener to the tinplating solution becomes null, but also the brightener aggregates in the tinplating solution. The resultant aggregate aheres to the tinplating layer formed on the surface of the metallic material, and causes the problem of a deteriorated quality of the tinplating layer. With an ethoxylation molar number "n" of over 14, on the other hand, not only the above-mentioned dispersing effect of the denaturations becomes insufficient, but also denaturations of the brightener itself are produced. The produced denaturations adhere to the tinplating layer formed on the surface of the metallic material, thus causing the problem of a deteriorated quality of the tinplating layer.

The content of the brightener in the acidic electro-tinplating solution should be at least 0.5 g per liter, of the tinplating solution. With a brightener content of under 0.5 g per liter of the tinplating solution, the dispersing effect of the denaturations becomes insufficient to achieve the desired object. With a brightener content of over 15 g per liter of the tinplating solution, on the other hand, no further improvement is available in the above-mentioned effect, thus making the addition of the brightener uneconomical. Therefore, the brightener content should preferably be within the range of from 0.5 to 15 g per liter of the tinplating solution.

The above-mentioned brightener can be prepared as follows: Ethylene oxide in an amount of from 8 to 14 mol is added to α-naphthol in an amount of 1 mol to ethoxylate α-naphthol. The thus produced ethoxylated α-naphthol is sulfornated by means of sulfuric acid having a concentration of at least 95% or fuming sulfuric acid having a concentration of up to 25% to prepare a brightener having the above-mentioned chemical structure.

When phenolsulfonic acid or the salt thereof in the acidic electro-tinplating solution contains free phenolsulfonic acid or a salt thereof in an amount within the range of from 5 to 25 g per liter of the tinplating solution, as converted into sulfuric acid, it is possible to inhibit the production of sludge caused by the oxidation of tin ion in the tinplating solution. The reason is as follows:

Part of tin ions in the acidic electro-tinplating solution combines with the brightener, whereas most part of tin ions repeats a cycle of combination with, and dissociation from, phenolsulfonic acid or the salt thereof in the tinplating solution. When tin ions are dissociated from phenolsulfonic acid or the salt thereof, tin ions combine with oxygen ions in the tinplating solution to produce sludge. Therefore, if free phenolsulfonic acid or a salt thereof in a prescribed amount is added to the tinplating solution, in addition to phenolsulfonic acid or the salt thereof, which repeats combination with and dissociation from tin ions, free phenolsulfonic acid or the salt thereof in the tinplating solution combines with the dissociated tin ions. This prevents combination of the dissociated tin ions with oxygen ions in the tinplating solution, thus inhibiting the production of sludge caused by the oxidation of tin ion.

The content of the above-mentioned free phenolsulfonic acid or the salt thereof in the acidic electro-tinplating solution should be within the range of from 5 to 25 g per liter of the tinplating solution, as converted into sulfuric acid. With a content of free phenolsulfonic acid or the salt thereof of under 5 g per liter of the tinplating solution, as converted into sulfuric acid, a desired effect cannot be obtained. With a content of free phenolsulfonic acid or the salt thereof of over 25 g per liter of the tinplating solution, as converted into sulfuric acid, on the other hand, hydrogen gas is produced on the surface of the metallic material in the tinplating solution, thus causing the problem of a decreased electrolysis efficiency.

As tin ion to be supplied for replenishment of the acidic electro-tinplating solution containing phenolsulfonic acid or the salt thereof and tin ion, it is desirable to use stannous oxide. The reason is as follows: Stannous oxide is easily dissolved in the tinplating solution. Therefore, it is not necessary, as in the case of using metallic tin as tin ion to be supplied for replenishment of the tinplating solution, to previously add a powdery metallic tin to another tinplating solution, and blow oxygen gas into the another tinplating solution to cause dissolution of the powdery metallic tin. This eliminates the necessity of a facility for dissolution of the powdery metallic tin, and the production of sludge caused by blowing of oxygen gas is prevented.

Any acidic electro-tinplating solution containing phenolsulfonic acid or a salt thereof and tin ion may be used as the tinplating solution. A conventional additive may be added as required to the tinplating solution, in addition to the brightener. There is no special limit on the tinplating conditions: appropriate conditions may be selected, depending upon the metallic material to be tinplated and the tinplating solution. A preferable tinplating conditions are as follows:

Tinplating solution temperature: from 30° to 60° C., and

Electric current density for tinplating: from 5 to 50 A/dm$^2$.

It is desirable to apply conventional pretreatments such as pickling and degreasing to the metallic material prior to the application of electro-tinplating.

Now, the method of the present invention is described further in detail by means of examples in comparison with examples for comparison.

EXAMPLE 1

An insoluble anode comprising an electric-conductive substrate, and a film comprising at least iridium oxide, formed on one surface of the electric-conductive substrate, was prepared as follows:

The following six kinds of compound were provided for the film to be formed on the surface of the electric-conductive substrate:

chloroiridiumic acid ($H_2IrCl_6.6H_2O$ ),
tantalum butoxide ($Ta(OC_4H_9)_5$),
tin butoxide ($Sn(OC_4H_9)_2$),
titanium butoxide ($Ti(OC_4H_9)_4$),
niobium butoxide ($Nb(OC_4H_9)_4$), and
chloroplatinic acid ($H_2PtCl_6.H_2O$)

Each of the above-mentioned compounds was dissolved in butanol to prepare a solution having a concentration of 100 g/l as converted into the metallic state. The thus prepared chloroiridiumic acid solution was mixed in a prescribed ratio with each of the tantalum butoxide solution, the tin butoxide solution, the titanium butoxide solution, the niobium butoxide solution and the chloroplatinic acid solution, and the resultant mixed solutions were sufficiently stirred. Thus, a mixed solution of the chloroiridiumic acid solution and the tantalum butoxide solution, a mixed solution of the chloroiridiumic acid solution and the tin butoxide solution, a mixed solution of the chloroiridiumic acid solution and the titanium butoxide solution, a mixed solution of the chloroiridiumic acid solution and the niobium butoxide solution, and a mixed solution of the chloroiridiumic acid solution and the chloroplatinic acid solution, were prepared.

As the electric-conductive substrate, a plurality of titanium plates having a prescribed thickness were prepared, and the surfaces of these titanium plates were washed by means of an aqueous solution of oxalic acid. Then, one of the above-mentioned five kinds of mixed solution and the chloroiridiumic acid solution was applied onto the surface of each of the prepared titanium plates, and then dried. The six kinds of titanium plate, on the surface of each of which a film having a chemical composition different from those of the others was thus formed, were heated in an electric furnace at a temperature of about 500° C. for ten minutes to bake the films. The above-mentioned cycle of treatments comprising application of the mixed solution or the chloroiridiumic acid solution, drying and baking, was repeated ten times to form a film comprising at least iridium oxide having a prescribed thickness on one surface of each of the titanium plates. Thus, six kinds of insoluble anode (A) to (F) within the scope of the present invention as shown in Table 1, each comprising the electric-conductive substrate, and the film comprising at least iridium oxide, formed on the surface of the electric-conductive substrate, were prepared.

TABLE 1

| Kind of insoluble anode | Chemical composition | |
|---|---|---|
| | Film | Substrate |
| (A) | $IrO_2$—$TA_2O_5$ | Ti |
| (B) | $IrO_2$—$SnO_2$ | Ti |
| (C) | $IrO_2$—$TiO_2$ | Ti |
| (D) | $IrO_2$—$Nb_2O_5$ | Ti |
| (E) | $IrO_2$—Pt | Ti |
| (F) | $IrO_2$ | Ti |

For comparison purposes, an insoluble anode outside the scope of the present invention comprising a titanium plate, the surface of which was platinum-plated, as conventionally used, was prepared. Then, the following three kinds of electrolytic solution (a), (b) and (c) were prepared:

(1) Electrolytic solution (a): Aqueous solution containing phenolsulfonic acid having a concentration of 100 g/l;

(2) Electrolytic solution (b): Aqueous solution containing phenolsulfonic acid having a concentration of 70 g/l and sulfuric acid having a concentration of 50 g/l;

(3) Electrolytic solution (c): Aqueous solution containing phenolsulfonic acid having a concentration of 70 g/l and ethoxylated naphthol (molar number of ethylene oxide: 5) having a concentration of 10 g/l.

An electrolysis was carried out under the following conditions by using each of the insoluble anode (A) to (F) within the scope of the present invention as shown in Table 1, using each of the above-mentioned electrolytic solutions (a) to (c), using a titanium plate as a cathode, and causing a DC current to flow between the insoluble anode and the cathode:

(1) Electric current density : 50 A/dm$^2$, and (2) Electrolytic solution temperature : 60° C.

For comparison purposes, another electrolysis was carried out under the same conditions as those described above except that the insoluble anode outside the scope of the present invention, comprising the titanium plate, the surface of which was platinum-plated, was used.

For each of the insoluble anodes within the scope of the present invention and the insoluble anodes outside the scope of the present invention, the state of production of the denaturations of phenolsulfonic acid in the electrolytic solution was investigated, and the results were evaluated. The criteria of evaluation were as follows:

◉ : Almost no denaturation is observed;

○ : Denaturations occur in a limited amount; and x : Denaturations seriously occur.

The results of evaluation are shown in Table 2

TABLE 2

| Chemical composition | | | Kind of electro-lytic solution | Occurence of denaturations |
|---|---|---|---|---|
| Film | (mol %) | Substrate | | |
| Insoluble anode of the invention | | | | |
| (A) $IrO_2$—$Ta_2O_5$ | (Ir/Ta = 70/30) | Ti | (a) | ◉ |
| (A) $IrO_2$—$Ta_2O_5$ | (Ir/Ta = 70/30) | Ti | (b) | ◉ |
| (A) $IrO_2$—$Ta_2O_5$ | (Ir/Ta = 70/30) | Ti | (c) | ◉ |
| (B) $IrO_2$—$SnO_2$ | (Ir/Sn = 60/40) | Ti | (c) | ◉ |
| (C) $IrO_2$—$TiO_2$ | (Ir/Ti = 50/50) | Ti | (a) | ◉ |
| (D) $IrO_2$—$Nb_2O_5$ | (Ir/Nb = 75/25) | Ti | (b) | ◉ |
| (E) $IrO_2$—Pt | (Ir/Pt = 30/70) | Ti | (a) | ○ |
| (E) $IrO_2$—Pt | (Ir/Pt = 30/70) | Ti | (b) | ○ |
| (F) $IrO_2$ | | Ti | (b) | ○ |
| (F) $IrO_2$ | | Ti | (c) | ○ |
| Insoluble anode for comparison | | | | |
| Pt | | Ti | (a) | x |
| Pt | | Ti | (b) | x |
| Pt | | Ti | (c) | x |

As is clear from Table 2, in the cases where the insoluble anodes outside the scope of the present invention comprising the titanium plate, the surface of which was platinum-plated, were used, the denaturations of phenolsulfonic acid were produced in a large quantity in the electrolytic solution. In contrast, in the cases where the insoluble anodes (A) to (D) within the scope of the present invention were used, almost no denaturation of phenolsulfonic acid was produced in the electrolytic solution in any cases. In the cases where the insoluble anodes (E) and (F) within the scope of the present invention were used, the denaturations of phenolsulfonic acid were produced in a small quantity in the electrolytic solution.

EXAMPLE 2

A brightener having an ethoxylation molar number and in an amount within the scope of the present invention, and free phenolsulfonic acid in an amount within the scope of the present invention, were added to an acidic electro-tinplating solution containing phenolsulfonic acid and tin ion, to prepare the acidic electrotinplating solution within the scope of the present invention.

A tinplating layer was continuously formed on the surface of a steel strip in accordance with the methods within the scope of the present invention (hereinafter referred to as the "methods of the invention") Nos. 1 to 13 as shown in Table 3 in the above-mentioned acidic electro-tinplating solution within the scope of the present invention by the use of any of the insoluble anodes (A), (B) and (C) within the scope of the present invention, under the following electrolytic conditions;

(1) Electric current density 30 A/dm$^2$, (2) Tinplating solution temperature: 40° C., (3) Tin ion supplied for replenishment of the tinplating solution: powdery stannous oxide, (4) Thickness of steel strip 0.2 mm, and (5) Weight of tinplating layer 2.8 g/m$^2$.

For comparison purposes, a tinplating layer was continuously formed on the surface of a steel strip in accordance with methods, in which at least one of the insoluble anode, the brightener, and the content of free phenolsulfonic acid in the tinplating solution was outside the scope of the present invention (hereinafter referred to as the "methods for comparison") Nos. 1 to 8 as shown in Table 3.

The conditions of the insoluble anode and the tinplating solution in each of the methods of the invention Nos. 1 to 13 and the methods for comparison Nos. 1 to 8, are shown in Table 3.

For each of the methods of the invention Nos. 1 to 13 and the methods for comparison Nos. 1 to 8, the state of production of the denaturations in the tinplating solution, dispersibility of the denaturations in the tinplating solution, and the amount of produced sludge in the tinplating solution, were investigated and evaluated. The criteria of evaluation of the state of production of the denaturations were the same as those mentioned above with reference to Table 2, and the criteria of evaluation of dispersibility of the denaturations were as follows:

○ : Denaturations show a satisfactory dispersibility; and x : Denaturations show a poor dispersibility.

The results of evaluation are shown in Table 4.

TABLE 4-continued

| No. | Occurrence of denaturations or aggregate | Dispersibility of denaturations | Amount of produced sludge (g/l) |
|---|---|---|---|
| Method for comparison | | | |
| 1 | x | x | 200 |
| 2 | x | x | 87 |
| 3 | x | x | 75 |
| 4 | x | x | 35 |
| 5 | x | x | 35 |
| 6 | x | x | 34 |
| 7 | ◉ | ○ | 157 |
| 8 | ◎ | ○ | 123 |

As is clear from Tables 3 and 4, in the method for comparison No. 1, using the insoluble anode outside the scope of the present invention comprising the titanium plate, the surface of which was platinum-plated, not containing the brightener in the tinplating solution, and using the tinplating solution having a low content of free phenolsulfonic acid outside the scope of the present invention, the denaturations of phenolsulfonic acid were produced in a large quantity in the tinplating solution, the produced denaturations showed a poor dispersibility, and sludge caused by the oxidation of tin ion was produced in a large quantity in the tinplating solution.

TABLE 3

| No. | Chemical composition of insoluble anode: Film | (mol %) | Substrate | Brightener: Kind | Content (g/l) | Tinplating solution: Tin-ion content (g/l) | Free phenolsulfonic acid content (g/l) |
|---|---|---|---|---|---|---|---|
| Method of the invention | | | | | | | |
| 1 | (A) $IrO_2$—$Ta_2O_5$ | (Ir/Ta = 70/30) | Ti | 8-ethoxylated α-naphthol sulfonic acid | 5 | 30 | 6.5 |
| 2 | (A) $IrO_2$—$Ta_2O_5$ | (Ir/Ta = 70/30) | Ti | 8-ethoxylated α-naphthol sulfonic acid | 10 | 30 | 11.2 |
| 3 | (A) $IrO_2$—$Ta_2O_5$ | (Ir/Ta = 70/30) | Ti | 10-ethoxylated α-naphthol sulfonic acid | 10 | 30 | 11.2 |
| 4 | (A) $IrO_2$—$Ta_2O_5$ | (Ir/Ta = 70/30) | Ti | 12-ethoxylated α-naphthol sulfonic acid | 10 | 30 | 11.2 |
| 5 | (A) $IrO_2$—$Ta_2O_5$ | (Ir/Ta = 70/30) | Ti | 12-ethoxylated α-naphthol sulfonic acid | 10 | 35 | 12.5 |
| 6 | (A) $IrO_2$—$Ta_2O_5$ | (Ir/Ta = 70/30) | Ti | 12-ethoxylated α-naphthol sulfonic acid | 10 | 40 | 18.5 |
| 7 | (A) $IrO_2$—$Ta_2O_5$ | (Ir/Ta = 70/30) | Ti | 14-ethoxylated α-naphthol sulfonic acid | 10 | 35 | 17.3 |
| 8 | (B) $IrO_2$—$SnO_2$ | (Ir/Sn = 60/40) | Ti | 12-ethoxylated α-naphthol sulfonic acid | 10 | 30 | 11.2 |
| 9 | (B) $IrO_2$—$SnO_2$ | (Ir/Sn = 60/40) | Ti | 12-ethoxylated α-naphthol sulfonic acid | 15 | 40 | 24.5 |
| 10 | (C) $IrO_2$—$TiO_2$ | (Ir/Ti = 30/70) | Ti | 10-ethoxylated α-naphthol sulfonic acid | 10 | 35 | 12.5 |
| 11 | (C) $IrO_2$—$TiO_2$ | (Ir/Ti = 30/70) | Ti | 12-ethoxylated α-naphthol sulfonic acid | 10 | 35 | 12.5 |
| 12 | (C) $IrO_2$—$TiO_2$ | (Ir/Ti = 30/70) | Ti | 12-ethoxylated α-naphthol sulfonic acid | 10 | 40 | 18.5 |
| 13 | (C) $IrO_2$—$TiO_2$ | (Ir/Ti = 30/70) | Ti | 14-ethoxylated α-naphthol sulfonic acid | 10 | 35 | 17.3 |
| Method for comparison | | | | | | | |
| 1 | Pt | | Ti | — | — | 30 | 3.5 |
| 2 | Pt | | Ti | 12-ethoxylated α-naphthol sulfonic acid | 10 | 30 | 11.2 |
| 3 | Pt | | Ti | 10-ethoxylated α-naphthol sulfonic acid | 10 | 35 | 12.5 |
| 4 | (B) $IrO_2$—$SnO_2$ | (Ir/Sn = 60/40) | Ti | 6-ethoxylated α-naphthol sulfonic acid | 10 | 40 | 18.5 |
| 5 | (A) $IrO_2$—$Ta_2O_5$ | (Ir/Ta = 70/30) | Ti | 15-ethoxylated α-naphthol sulfonic acid | 10 | 30 | 11.2 |
| 6 | (C) $IrO_2$—$TiO_2$ | (Ir/Ti = 30/70) | Ti | 15-ethoxylated α-naphthol sulfonic acid | 10 | 35 | 12.5 |
| 7 | (A) $IrO_2$—$Ta_2O_5$ | (Ir/Ta = 70/30) | Ti | 12-ethoxylated α-naphthol sulfonic acid | 10 | 30 | 3.5 |
| 8 | (B) $IrO_2$—$SnO_2$ | (Ir/Sn = 60/40) | Ti | 12-ethoxylated α-naphthol sulfonic acid | 5 | 30 | 4.3 |

TABLE 4

| No. | Occurrence of denaturations or aggregate | Dispersibility of denaturations | Amount of produced sludge (g/l) |
|---|---|---|---|
| Method of the invention | | | |
| 1 | ◎ | ○ | 55 |
| 2 | ◎ | ○ | 40 |
| 3 | ◎ | ○ | 45 |
| 4 | ◎ | ○ | 41 |
| 5 | ◉ | ○ | 35 |
| 6 | ◎ | ○ | 32 |
| 7 | ◎ | ○ | 37 |
| 8 | ◎ | ○ | 43 |
| 9 | ◎ | ○ | 40 |
| 10 | ◎ | ○ | 44 |
| 11 | ◎ | ○ | 40 |
| 12 | ◎ | ○ | 33 |
| 13 | ◎ | ○ | 55 |

In the methods for comparison Nos. 2 and 3, each using the insoluble anode outside the scope of the present invention comprising the titanium plate, the surface of which was platinum-plated, although using the tinplating solution containing the brightener within the scope of the present invention and free phenolsulfonic acid in an amount within the scope of the present invention, the denaturations of phenolsulfonic acid were produced in a large quantity in the tinplating solution, and the amount of sludge in the tinplating solution was rather large. The produced denaturations were temporarily dispersed in the tinplating solution under the effect of the brightener. However, because of the very large quantity of the produced denaturations, the denaturations aggregated again along with the lapse of time.

In the method for comparison No.4, using the insoluble anode (B) within the scope of the present invention as shown in Table 1, and having the content of free phenolsulfonic acid in the tinplating solution within the scope of the present invention, but having a low ethoxylation molar number of the brightener contained in the tinplating solution outside the scope of the present invention, although almost no denaturation of phenolsulfonic acid was produced in the tinplating solution and there was produced sludge only in a limited amount in the tinplating solution, the brightener aggregated in the tinplating solution, and the resultant aggregate caused problems similar to those caused by the denaturations of phenolsulfonic acid. The denaturations, even when produced, had a poor dispersibility.

In the methods for comparison Nos. 5 and 6, each using the insoluble anode (A) or (C) within the scope of the present invention as shown in Table 1, and having the content of free phenolsulfonic acid in the tinplating solution within the scope of the present invention, but having a high ethoxylation molar number of the brightener contained in the tinplating solution outside the scope of the present invention, although almost no denaturation of phenolsulfonic acid was produced in the tinplating solution and there was produced sludge only in a limited amount in the tinplating solution, denaturations of the brightener itself were produced in the tinplating solution, and the produced denaturations showed a low dispersibility.

In the methods for comparison Nos. 7 and 8, each using the insoluble anode (A) or (B) within the scope of the present invention as shown in Table 1, and having the ethoxylation molar number of the brightener contained in the tinplating solution within the scope of the present invention, but having a low content of free phenolsulfonic acid in the tinplating solution outside the scope of the present invention, although almost no denaturation of phenolsulfonic acid was produced, and the denaturations, even when produced, had a satisfactory dispersibility. However, sludge caused by the oxidation of tin ion was produced in a large quantity in the tinplating solution.

On the contrary, in the methods of the invention Nos. 1 to 13, each using any one of the insoluble anodes (A), (B) and (C) within the scope of the present invention as shown in Table 1, and having the ethoxylation molar number of the brightener contained in the tinplating solution and the content of free phenolsulfonic acid in the tinplating solution, both within the scope of the present invention, almost no denaturation of phenolsulfonic acid was produced in the tinplating solution, almost no denaturation or aggregate of the brightener was produced in the tinplating solution, the denaturations, even when produced, were finely dispersed in the tinplating solution, and there was produced sludge caused by the oxidation of tin ion only in a limited amount in the tinplating solution. Thus, it was possible to continuously form a tinplating layer having an excellent quality on the surface of the steel strip.

According to the method of the present invention, as described above in detail, when using an acidic electro-tinplating solution containing phenolsulfonic acid or a salt thereof and tin ion, using an insoluble anode, and causing a DC electric current to flow between the insoluble anode and a metallic material, while replenishing the acidic electro-tinplating solution with tin ion, thereby forming a tinplating layer on the surface of the metallic material, it is possible to prevent the production of the denaturations of phenolsulfonic acid or the salt thereof and other denaturations or aggregate in the tinplating solution, to cause fine dispersion of the denaturations, even when produced, in the tinplating solution, and to inhibit the production of sludge caused by the oxidation of tin ion in the tinplating solution, thereby permitting stable formation of a tinplating layer having an excellent quality on the surface of the metallic material, thus providing many industrially useful effects.

What is claimed is:

1. In a method for continuously electro-tinplating a metallic material, which comprises the steps of:

using an acidic electro-tinplating solution containing phenolsulfonic acid or a salt thereof and tin ion, using an insoluble anode, and causing a DC electric current to flow between said insoluble anode and a metallic material, while replenishing said acidic electro-tinplating solution with tin ion, thereby forming a tinplating layer on the surface of said metallic material;

the improvement characterized in that:

said insoluble anode comprises an electric-conductive substrate, and a film comprising at least iridium oxide, formed on the surface of said electric-conductive substrate.

2. The method as claimed in claim 1, wherein:

said acidic electro-tinplating solution further additionally contains a brightener as represented by the following general formula:

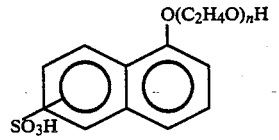

where, n=8 to 14, in an amount within the range of from 0.5 to 15 g per liter of said acidic electro-tinplating solution.

3. The method as claimed in claim 1 or 2, wherein:

said phenolsulfonic acid or the salt thereof in said acidic electro-tinplating solution contains free phenolsulfonic acid or a salt thereof in an amount within the range of from 5 to 25 g per liter of said acidic electro-tinplating solution, as converted into sulfuric acid.

4. The method as claimed in claim 1 or 2, wherein:

said electric-conductive substrate of said insoluble anode comprises at least one element selected from the group consisting of titanium, tantalum, niobium and zirconium.

5. The method as claimed in claim 1 or 2, wherein:

said film of said insoluble anode comprises iridium oxide.

6. The method as claimed in claim 1 or 2, wherein:

said film of said insoluble anode comprises iridium oxide and at least one component selected from the group consisting of titanium oxide, tantalum oxide, niobium oxide and tin oxide.

7. The method as claimed in claim 1 or 2, wherein:

stannous oxide is used as said tin ion to be supplied for replenishment of said acidic electrotin-plating solution.

* * * * *